US007036719B1

(12) United States Patent
Helphrey et al.

(10) Patent No.: US 7,036,719 B1
(45) Date of Patent: May 2, 2006

(54) LOC-A-WAY MAILBOX

(75) Inventors: Rosemarie Helphrey, San Bernardino, CA (US); Dale Helphrey, San Bernardino, CA (US)

(73) Assignee: Dale G. Helphrey, San Bernardino, CA (US)

( * ) Notice: Subject to any disclaimer, the term of this patent is extended or adjusted under 35 U.S.C. 154(b) by 0 days.

(21) Appl. No.: 11/050,236

(22) Filed: Feb. 2, 2005

Related U.S. Application Data

(60) Provisional application No. 60/544,813, filed on Feb. 17, 2004.

(51) Int. Cl.
*B65G 11/04* (2006.01)

(52) U.S. Cl. ..... 232/47; 232/39; 232/48; 232/54; 232/30; 248/679; 248/346.01

(58) Field of Classification Search ..... 232/45, 232/47, 48, 43.1, 39, 54, 30–32; 248/679, 248/678, 346.01

See application file for complete search history.

(56) References Cited

U.S. PATENT DOCUMENTS

| | | | | | |
|---|---|---|---|---|---|
| 378,955 | A | * | 3/1888 | Dubey | 232/17 |
| 400,299 | A | * | 3/1889 | Chappell et al. | 232/48 |
| 403,790 | A | * | 5/1889 | Taylor | 232/24 |
| 533,518 | A | * | 2/1895 | White | 232/54 |
| 722,323 | A | * | 3/1903 | Parker | 232/54 |
| 1,111,031 | A | * | 9/1914 | Petri | 232/48 |
| 4,753,386 | A | | 6/1988 | Phillon, Sr. | |
| 4,793,551 | A | * | 12/1988 | Baylor | 232/17 |
| 5,000,378 | A | * | 3/1991 | Dorr et al. | 232/17 |
| 5,071,063 | A | * | 12/1991 | Overstreet | 232/17 |
| 5,148,974 | A | * | 9/1992 | Clapper | 232/17 |
| 5,435,484 | A | * | 7/1995 | Carlson | 232/47 |
| 6,347,737 | B1 | | 2/2002 | Madruga | |
| 6,375,071 | B1 | | 4/2002 | Kim | |
| 6,588,656 | B1 | * | 7/2003 | Cox et al. | 232/47 |
| 6,840,438 | B1 | * | 1/2005 | Hassan | 232/54 |

* cited by examiner

*Primary Examiner*—William L. Miller

(57) ABSTRACT

A mail receptacle for use in public and private settings. The mail receptacle has an upper mail insertion area and a lower storage area. An individual placing mail in the upper mail insertion area would need to press down on a pair of pivotally attached doors, allowing the item of mail to fall into the storage area for later retrieval.

3 Claims, 4 Drawing Sheets

LOC-A-WAY MAILBOX

CROSS-REFERENCE TO RELATED APPLICATIONS

This application claims the benefit of U.S. Provisional Application No. 60/544,813, filed Feb. 17, 2004.

BACKGROUND OF THE INVENTION

The present invention concerns that of a new and improved mail receptacle for use in public and private settings.

DESCRIPTION OF THE PRIOR ART

U.S. Pat. No. 4,753,386, issued to Phillion Sr., discloses a mailbox comprised of a first compartment with a hinged door in the floor to drop mail to a second lower compartment with a locking rear door.

U.S. Pat. No. 6,347,737, issued to Madruga, discloses a mailbox with a hinged loading door leading to a secondary section to prevent unauthorized access.

U.S. Pat. No. 6,375,071, issued to Kim, discloses a mailbox with an upper section and a locked lower section to store deliveries in a secure manner.

SUMMARY OF THE INVENTION

The present invention concerns that of a new and improved mail receptacle for use in public and private settings. The mail receptacle has an upper mail insertion area and a lower storage area. An individual placing mail in the upper mail insertion area would need to press down on a pair of pivotally attached doors, allowing the item of mail to fall into the storage area for later retrieval.

There has thus been outlined, rather broadly, the more important features of a mail receptacle that the detailed description thereof that follows may be better understood and in order that the present contribution to the art may be better appreciated. There are, of course, additional features of mail receptacle that will be described hereinafter and which will form the subject matter of the claims appended hereto.

In this respect, before explaining at least one embodiment of the mail receptacle in detail, it is to be understood that the mail receptacle is not limited in its application to the details of construction and to the arrangements of the components set forth in the following description or illustrated in the drawings. The mail receptacle is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present mail receptacle. It is important, therefore, that the claims be regarded as including such equivalent constructions insofar as they do not depart from the spirit and scope of the present invention.

It is therefore an object of the present invention to provide a mail receptacle which has all of the advantages of the prior art and none of the disadvantages.

It is another object of the present invention to provide a mail receptacle which may be easily and efficiently manufactured and marketed.

It is another object of the present invention to provide a mail receptacle which is of durable and reliable construction.

It is yet another object of the present invention to provide a mail receptacle which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
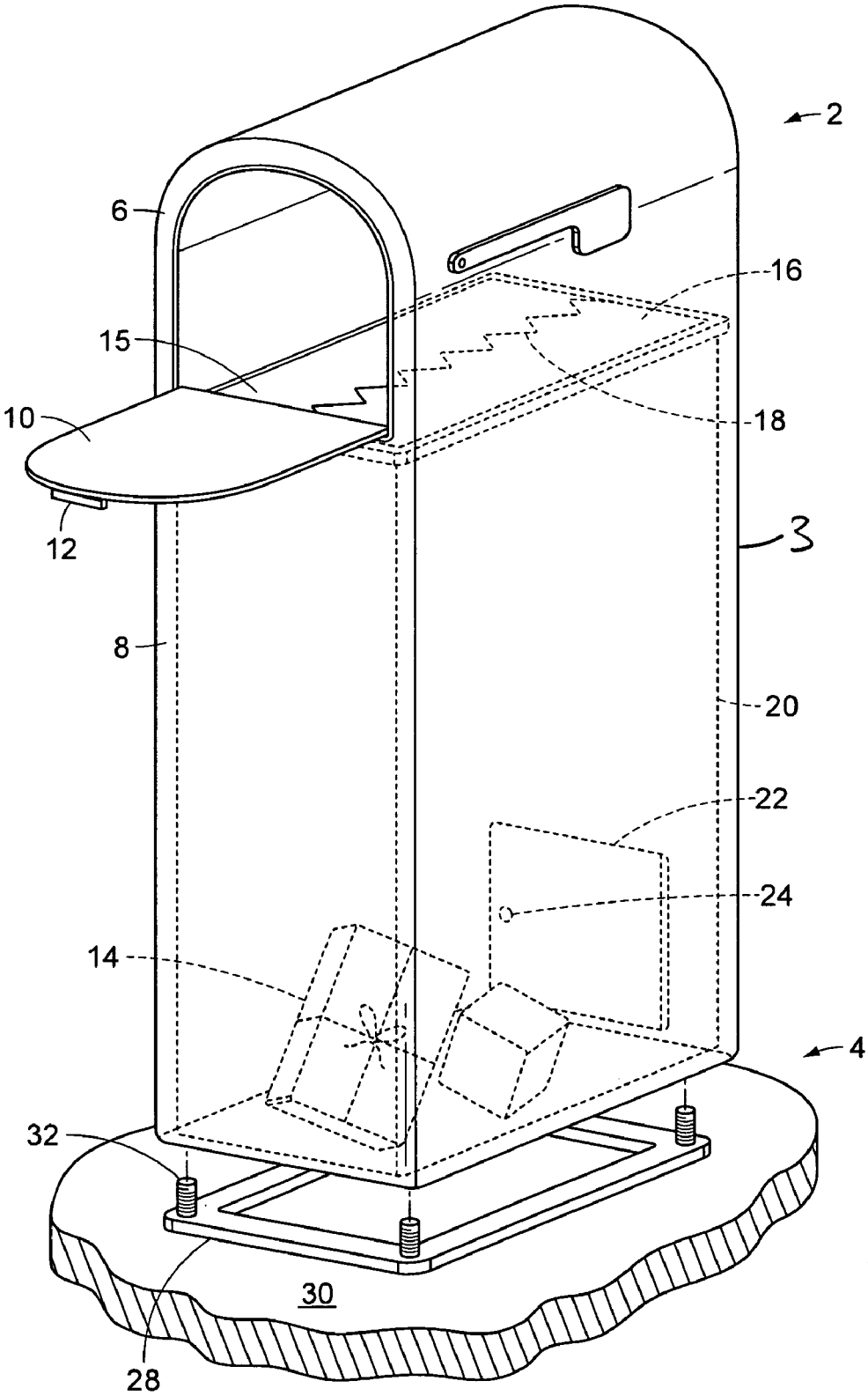
FIG. 1 shows a perspective view of the mail receptacle and the associated foundation used to keep the mail receptacle in place.

FIG. 1 shows a perspective view of the mail receptacle 2 and the associated foundation 4 used to keep the mail receptacle in place. Mail receptacle 2 looks just like a standard mailbox and comprises an outer casing 3 that has two ends, a top end and a bottom end, and four sides comprising a front side, rear side, left side, and a right side. The outer casing 3 preferably has a square- or rectangular-shaped cross-section.

The area within the outer casing 3 is divided into two separate sections. The upper section is the mail insertion area 6, while the lower section is the storage area 8. The storage area 8 occupies most of the room within the outer casing 3 and allows large volumes of mail to be stored until someone with proper authority retrieves the mail within the mail receptacle 2.

The front side of the outer casing 3 near the top end of the outer casing 3 has a pivoting door 10 that has a top-mounted tab 12. An individual can pull down on tab 12 to open the door 10 to insert an item of mail 14. Base doors 15 and 16 are located in between the first section and the second section of the outer casing 3 and are pivotally mounted within the outer casing 3. Base doors 15 and 16 are normally connected to one another by a plurality of interlocking teeth 18, but when they are gently pushed down, they will go down, allowing mail or other items within the mail insertion area 6 to literally "fall" into the storage area 8. The base doors 15 and 16 are pivotally mounted in such a manner to insure that they will retract to a position where they are connected to one another again once downward pressure upon them is removed, thereby protecting the mail in the storage area 8 from being improperly taken by unauthorized individuals.

Within the storage area 8 is located a container 20 that will store mail until it is picked up by an authorized person. The rear side of outer casing 3 has an access door 22 which is located near the bottom end of the outer casing 3. Access door 22 is pivotally mounted and has a lock 24 that prevents unauthorized access to the mail located within the storage area 8.

Figure 2:
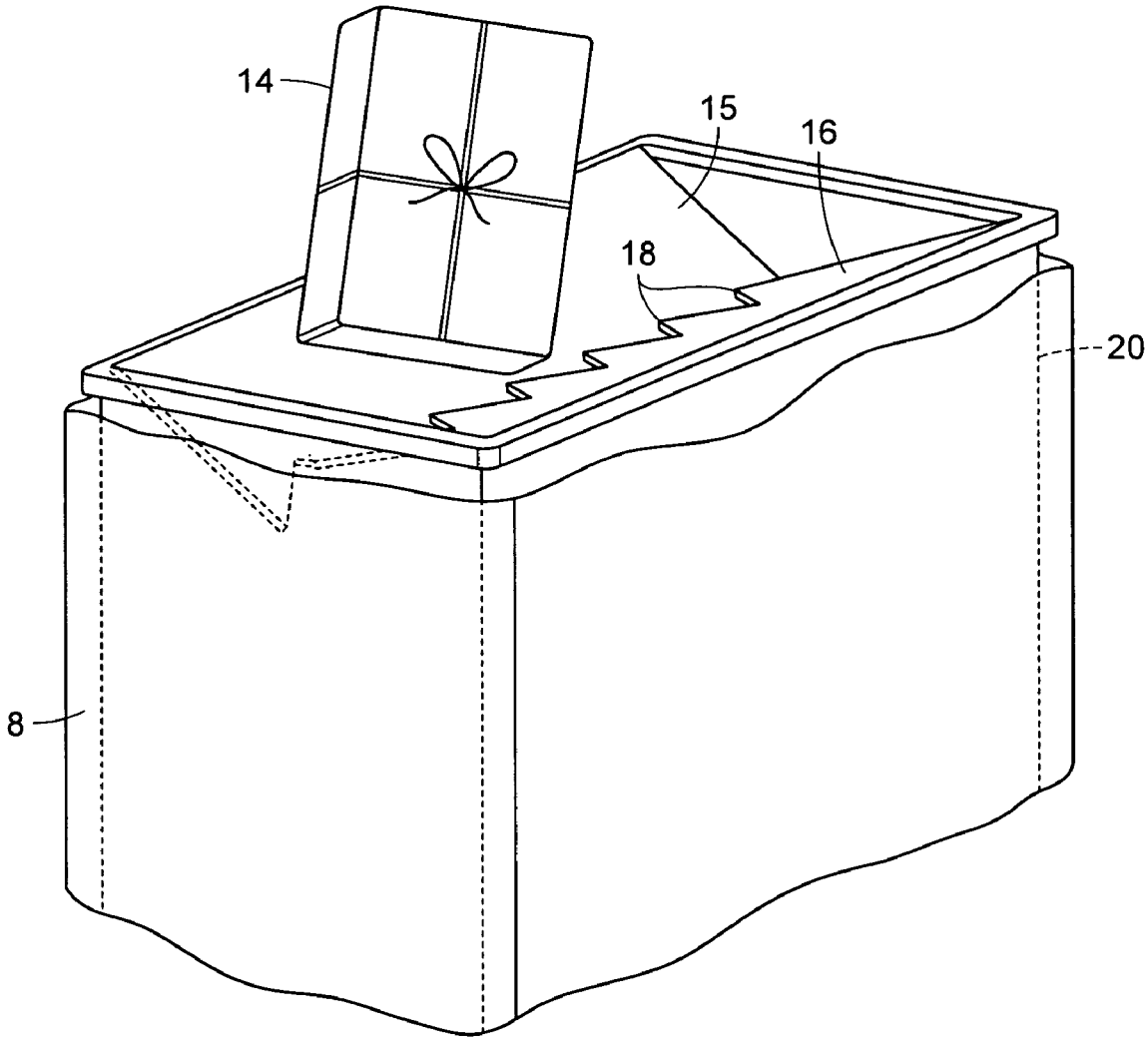
FIG. 2 shows a perspective view of the two pivoting doors that are the bottom surface of the mail insertion area.

FIG. 2 shows a perspective view of the two base doors 15 and 16 that are the bottom surface of the mail insertion area 6. An item of mail 14 is being pushed through the doors 15 and 16, causing them pivot downward and allow the item of mail 14 to be fall into the storage area 8.

Figure 3:
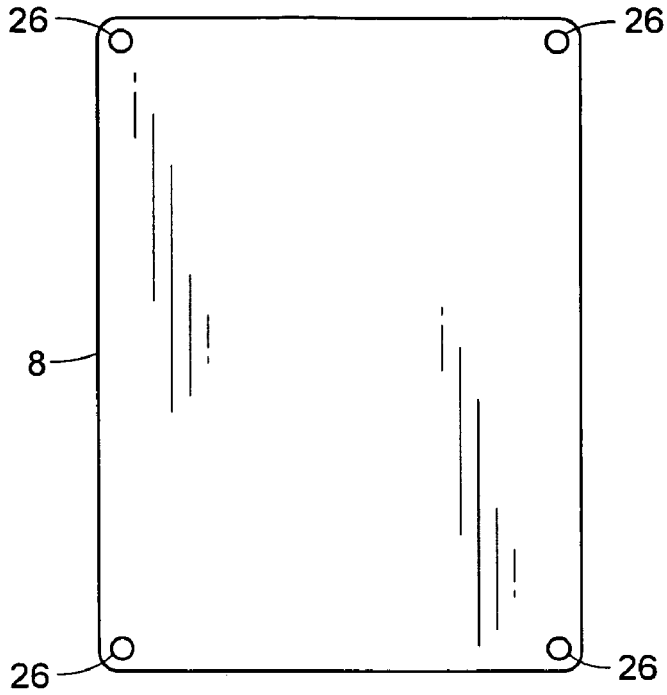
FIG. 3 shows a face view of the bottom surface of the mail receptacle.

FIG. 3 shows a face view of the bottom end of the outer casing 3. As can be seen, the outer casing 3 has a rectangular cross-sectional shape and has four corners. The bottom end of the outer casing 3 has four holes 26 to allow proper mounting of the mail receptacle 2 on the mounting plate 28. Each of the holes 26 is located at a corner of the outer casing 3

Figure 4:
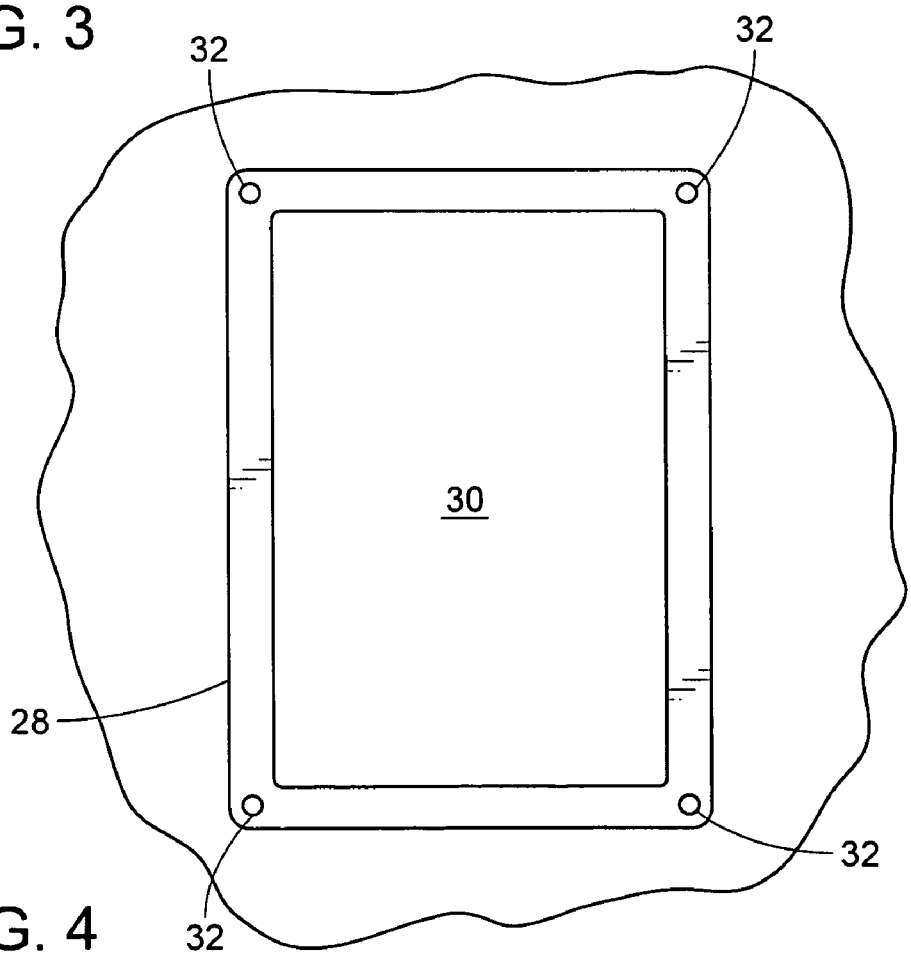
FIG. 4 shows a face view of the foundation and mounting plate associated with the mail receptacle.

FIG. 4 shows a face view of the foundation 30 and mounting plate 28 associated with the outer casing 3. Foundation 30 is merely a representational drawing, as the actual foundation 30 can be any one of a wide variety items, including a flat surface or a concrete or cement block.

Mounting plate 28 has two surfaces, a top surface and a bottom surface. The bottom surface of the mounting plate 28 is the surface placed against the foundation 30. Mounting plate 28 itself is a rectangular shaped bracket and has four corners, with four upright posts 32 located on the corners of the bracket on the top surface of the mounting plate 28. The posts 32 are meant to be inserted into the holes 26 on the bottom end of the outer casing 3. The posts 32 can be threaded, allowing the outer casing 3 to be threadably attached to the foundation 30, or in the alternative, the posts 32 could allow the outer casing 3 to be attached to the mail receptacle in some other manner.

Figure 5:
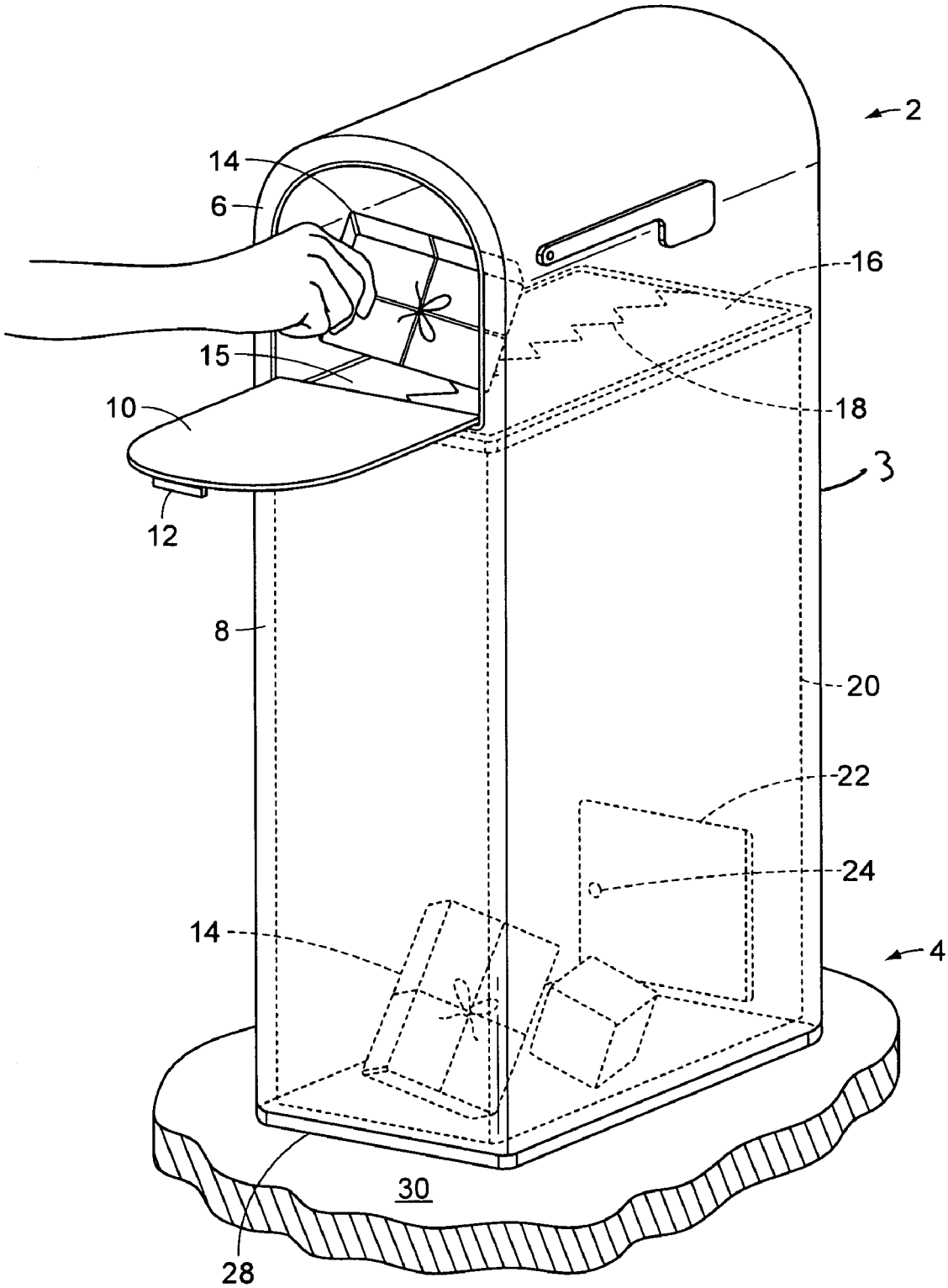
FIG. 5 shows a perspective view of the present invention as it would appear in use.

FIG. 5 shows a perspective view of the present invention as it would appear in use. An individual is placing an item of mail 14 into the mail insertion area 6 and pushing downward on base doors 15 and 16, where it will fall into the container 20 within the storage area 8.

We claim:

1. A mail receptacle comprising:

(a) an outer casing having two ends, a top end and a bottom end, the outer casing also having four sides comprising a front side, a rear side, a left side, and a right side, the outer casing having a square- or rectangular-shaped cross-section, (b) a pair of sections located within the outer casing comprising an upper section and a lower section, the upper section being a mail insertion area, the lower section being a storage area, (c) a door pivotally attached to the front side of the outer casing near the top end of the outer casing, the pivoting door having a top-mounted tab, (d) a pair of base doors comprising a first base door and a second base door, the pair of base doors being located in between the first section and the second section within the outer casing, the pair of base doors being pivotally mounted within the outer casing, (e) means for keeping the first base door and the second base door connected to one another when the first base door and the second base door are shut, (f) a container located within the lower section, (g) an access door located on the rear side of the outer casing near the bottom end of the outer casing, the access door being pivotally attached to the outer casing, and (h) means for fixedly mounting the outer casing onto a fixed object; wherein the means for keeping the first base door and the second base door connected to one another when the first base door and the second base door are shut further comprises a plurality of interlocking teeth, the plurality of interlocking teeth being located on the first base door and the second base door, the plurality of interlocking teeth on each base door being in contact with each other;

and wherein the means for fixedly mounting the outer casing onto a fixed object further comprises: (a) a quartet of holes located on the bottom end of the outer casing, each of the holes being located near a corner, (b) a foundation, (c) a mounting plate having two surfaces, a top surface and a bottom surface, the bottom surface of the mounting plate attached to the foundation, the mounting plate having a square or rectangular shape, the mounting plate having four corners, (d) a quartet of upright posts, each of the posts being placed on one of the corners of the mounting plate on the top surface of the mounting plate, (e) wherein the outer casing is placed on top of the mounting plate so as cause the upright posts to be inserted into the quartet of holes located on the bottom end of the outer casing.

2. A mail receptacle according to claim 1 wherein the upright posts are externally threaded.

3. A mail receptacle according to claim 1 wherein the mail receptacle further comprises a lock, the lock being used to lock the access door.

* * * * *